US012798844B2

(12) United States Patent
Bytheway et al.

(10) Patent No.: US 12,798,844 B2
(45) Date of Patent: Nov. 17, 2026

(54) SEALING MECHANISM FOR A BEVERAGE CONTAINER

(71) Applicant: RUNWAY BLUE, LLC, Lehi, UT (US)

(72) Inventors: David Bytheway, Springville, UT (US); David O. Meyers, Layton, UT (US); John R. Omdahl, II, Lindon, UT (US)

(73) Assignee: Runway Blue, LLC, Lehi, UT (US)

( * ) Notice: Subject to any disclaimer, the term of this patent is extended or adjusted under 35 U.S.C. 154(b) by 18 days.

(21) Appl. No.: 18/805,763

(22) Filed: Aug. 15, 2024

(65) Prior Publication Data

US 2025/0066086 A1 Feb. 27, 2025

Related U.S. Application Data

(60) Provisional application No. 63/520,784, filed on Aug. 21, 2023.

(51) Int. Cl.

| | |
|---|---|
| ***B65D 53/02*** | (2006.01) |
| ***B65D 47/08*** | (2006.01) |
| ***B65D 51/24*** | (2006.01) |
| ***B65D 55/02*** | (2006.01) |

(52) U.S. Cl.

CPC ..... *B65D 53/02* (2013.01); *B65D 47/0857* (2013.01); *B65D 51/246* (2013.01); *B65D 55/02* (2013.01)

(58) Field of Classification Search

CPC ..... B65D 47/065; B65D 47/2031; B65D 51/242; B65D 53/02; B65D 47/0857; B65D 51/246; B65D 55/02; B65D 55/04; B65D 47/0871; A47G 19/2266

See application file for complete search history.

(56) References Cited

U.S. PATENT DOCUMENTS

| | | | | |
|---|---|---|---|---|
| 5,996,859 | A | 12/1999 | Beck | |
| 7,059,490 | B2 * | 6/2006 | Son | B65D 51/007 222/534 |
| 8,622,229 | B2 * | 1/2014 | Lane | B65D 43/26 215/388 |
| 9,820,595 | B2 * | 11/2017 | Davies | A47G 19/2272 |
| 11,278,139 | B2 * | 3/2022 | Sorensen | A47J 43/27 |

(Continued)

OTHER PUBLICATIONS

International Search Report for International Application No. PCT/US24/42525, International Searching Authority, mailed on Nov. 20, 2024, 2 pages.

*Primary Examiner* — Kareen K Thomas
(74) *Attorney, Agent, or Firm* — Sterne, Kessler, Goldstein & Fox P.L.L.C.

(57) ABSTRACT

Some embodiments described herein are directed to a lid for beverage container having a lid body, a closure, and a seal member. The lid body has a spout defining a first drinking opening and a second drinking opening through the lid body and a latch. The closure is rotatably coupled to the lid body and configured to rotate between a closed position in which the closure covers the lid body and an open position in which the closure does not cover the lid body. The seal member is coupled to the closure and configured to seal around an outer surface of a rim of the spout when the closure is in the closed position. The latch is configured to engage with the closure to retain the closure in the closed position.

16 Claims, 7 Drawing Sheets

(56) References Cited

U.S. PATENT DOCUMENTS

| | | | | |
|---|---|---|---|---|
| 2003/0102318 | A1* | 6/2003 | Lee | B65D 47/066 222/530 |
| 2013/0056501 | A1* | 3/2013 | Beilke | B65D 47/0828 222/478 |
| 2015/0013270 | A1* | 1/2015 | Chisholm | B65D 51/1683 215/262 |
| 2015/0048124 | A1 | 2/2015 | Wisniewski | |
| 2018/0099792 | A1 | 4/2018 | Jacobsen et al. | |
| 2019/0344934 | A1* | 11/2019 | Faerber | B65D 47/0871 |
| 2022/0041347 | A1* | 2/2022 | Skillin | B65D 47/0809 |
| 2022/0177201 | A1 | 6/2022 | Meyers et al. | |
| 2023/0312179 | A1* | 10/2023 | Meyers | B65D 25/2835 220/200 |

* cited by examiner

SEALING MECHANISM FOR A BEVERAGE CONTAINER

CROSS REFERENCE TO RELATED APPLICATIONS

This application claims the benefit of U.S. Provisional Application No. 63/520,784, filed Aug. 21, 2023, which is incorporated herein in its entirety.

FIELD

This disclosure generally relates to a lid for beverage containers. More specifically, some embodiments relate to seals and sealing mechanisms on a lid for beverage containers.

BACKGROUND

A lid for beverage containers may have openings for dispensing a beverage held in the containers, and the openings may be sealed by a closure. When the closure seals on a top surface of the openings, a downward force is required to ensure proper sealing between the closure and the top surface of the openings.

SUMMARY

Some embodiments disclosed herein are directed to a lid for a beverage container including a lid body, a closure, and a seal member. The lid body has a spout defining a first drinking opening and a second drinking opening through the lid body and a latch. The closure is rotatably coupled to the lid body and configured to rotate between a closed position in which the closure covers the lid body and an open position in which the closure does not cover the lid body. The seal member is coupled to the closure and configured to seal around an outer surface of a rim of the spout when the closure is in the closed position. The latch is configured to engage with the closure to retain the closure in the closed position.

BRIEF DESCRIPTION OF THE FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Figure 1:
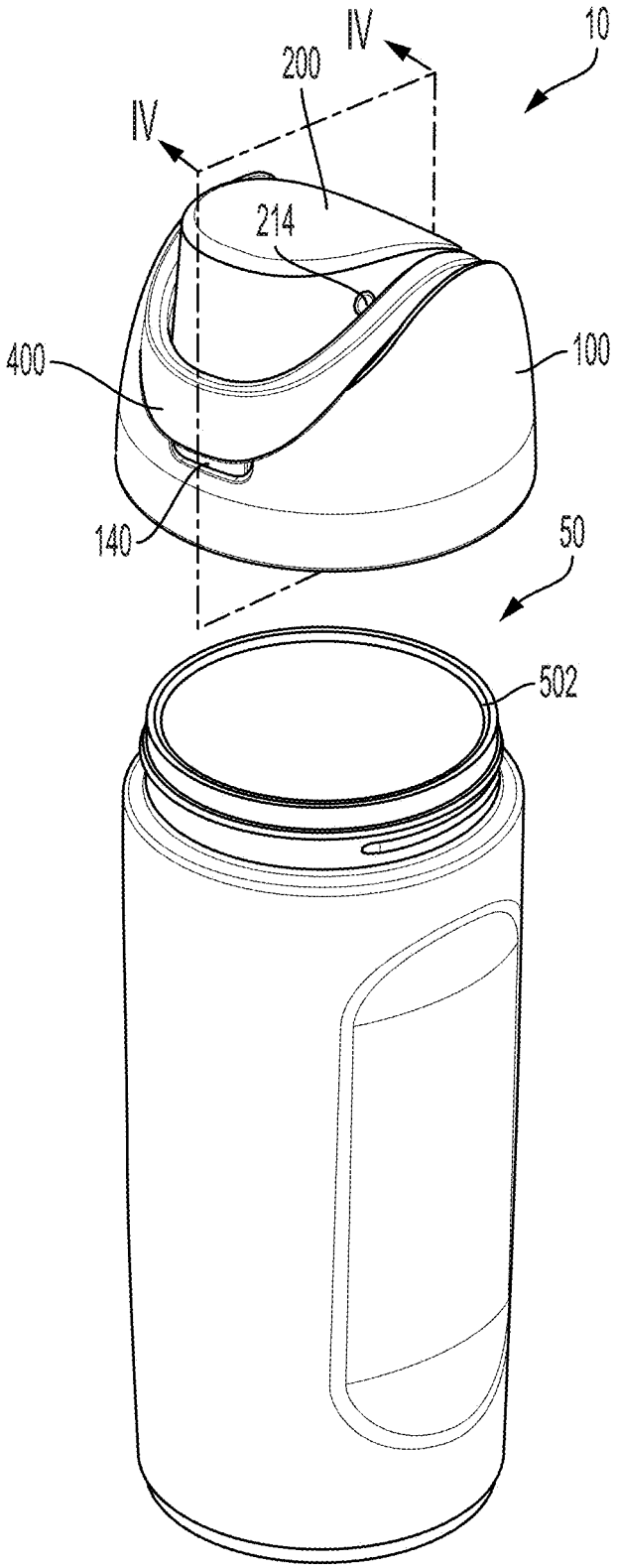
FIG. 1 shows a perspective view of a lid for beverage containers in a closed position.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein comport with standards used by those experienced or skilled in the art to most effectively convey the substance of their work to others skilled in the art. In some instances, well-known methods, procedures, and components have not been described in detail to avoid unnecessarily obscuring aspects of the disclosure.

References in the specification to "some embodiments" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to apply such feature, structure, or characteristic in connection with other embodiments whether or not explicitly described.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

People use reusable containers to carry a variety of beverages. It is often desirable for a container to be airtight when a user is not drinking from it so that the beverage being carried will not leak. An airtight container may be achieved by sealing the drinking opening of the container, for example with a closure and a seal. Sometimes, the closure and the seal may seal the top surface of the drinking opening, which requires a sufficient amount of force to push the closure and the seal towards the top surface of the drinking opening to ensure a proper sealing of the drinking opening. Sufficient force may sometimes be provided through a threaded or other connection that requires the user to apply a significant amount of force to effectively seal the opening. It is therefore desirable to reduce the force required to ensure a proper sealing of the drinking opening.

People also prefer to drink beverages from a container in different ways. For example, some people prefer to drink beverages with a straw, and some people prefer to drink beverages directly from an opening by titling the container. Accordingly, a beverage container may include a spout having a first drinking opening and a second drinking opening, with the second opening attachable to a straw, so that a user may either drink directly from the spout by titling the container or drink by sucking through the straw.

Sometimes, the first drinking opening and the second drinking opening are sealed separately, such that there is no fluid communication between the first opening and the second drinking opening for the air above the liquid surface. For example, where the first opening opens directly into an airspace above liquid contained within the container, and the second opening is connected to a straw that opens beneath liquid contained within the container, there is no air communication between first opening and second opening when they are each independently sealed.

Sometimes a pressure differential can develop between the pressure within the container and the ambient pressure outside of the container (e.g., from a change in temperature of a contained beverage, or from a change in elevation), and this pressure differential equalizes once the container is unsealed. For example, when the pressure within the container is higher than the ambient pressure, the air within the container can become compressed, and expands once the container is unsealed in order to equalize with the ambient pressure.

When a container is provided with a first drinking opening and a second drinking opening that are sealed separately, one of the openings may unseal first. In the case where the first-to-unseal opening leads to a straw that is submerged in liquid, the air still sealed behind the other opening (e.g., in the headspace of the container) could expand and push the liquid below it, displacing the liquid and possibly forcing some of it up through the straw towards (and potentially out from) the unsealed opening.

In some situations, a relatively small pressure differential can cause a significant enough expansion of air to displace a significant amount of liquid. And if an opening having a smaller diameter (e.g., a straw opening) is unsealed first, the displaced liquid caused by air expansion from the other opening may be forced to flow out of the smaller opening, thereby creating a mess. The risk of displacing liquid between two openings during this equalization process is significantly reduced by unsealing both openings at the same time. It is therefore desirable to not seal the first opening and the second drinking opening separately by creating a fluid communication between the first opening and the second drinking opening while they are sealed from the ambient environment.

Some embodiments of the present disclosure provide a lid having a closure that seals a spout radially around an outer surface of the rim. Instead of sealing on the top surface of the spout, the closure does not need to be pressed against (and in some cases may not contact) the top surface of the spout. This may reduce the force required to close the closure and to ensure proper sealing between the closure and spout. This can enable use of a wider variety of closure types, such as a hinged flip-top latch-style closure, and can facilitate a user's experience by requiring lower force to close and seal the closure.

Some embodiments of the present disclosure provide a lid having a spout that is separated into a first drinking opening and a second drinking opening, and a closure, where the closure seals the spout radially around an outer surface of the rim of the spout, and when sealed creates a channel between the first drinking opening and the second drinking opening to allow air pressure to equalize between the first drinking opening and the second drinking opening.

These and other embodiments are discussed below in more detail with reference to the figures.

Figure 2:
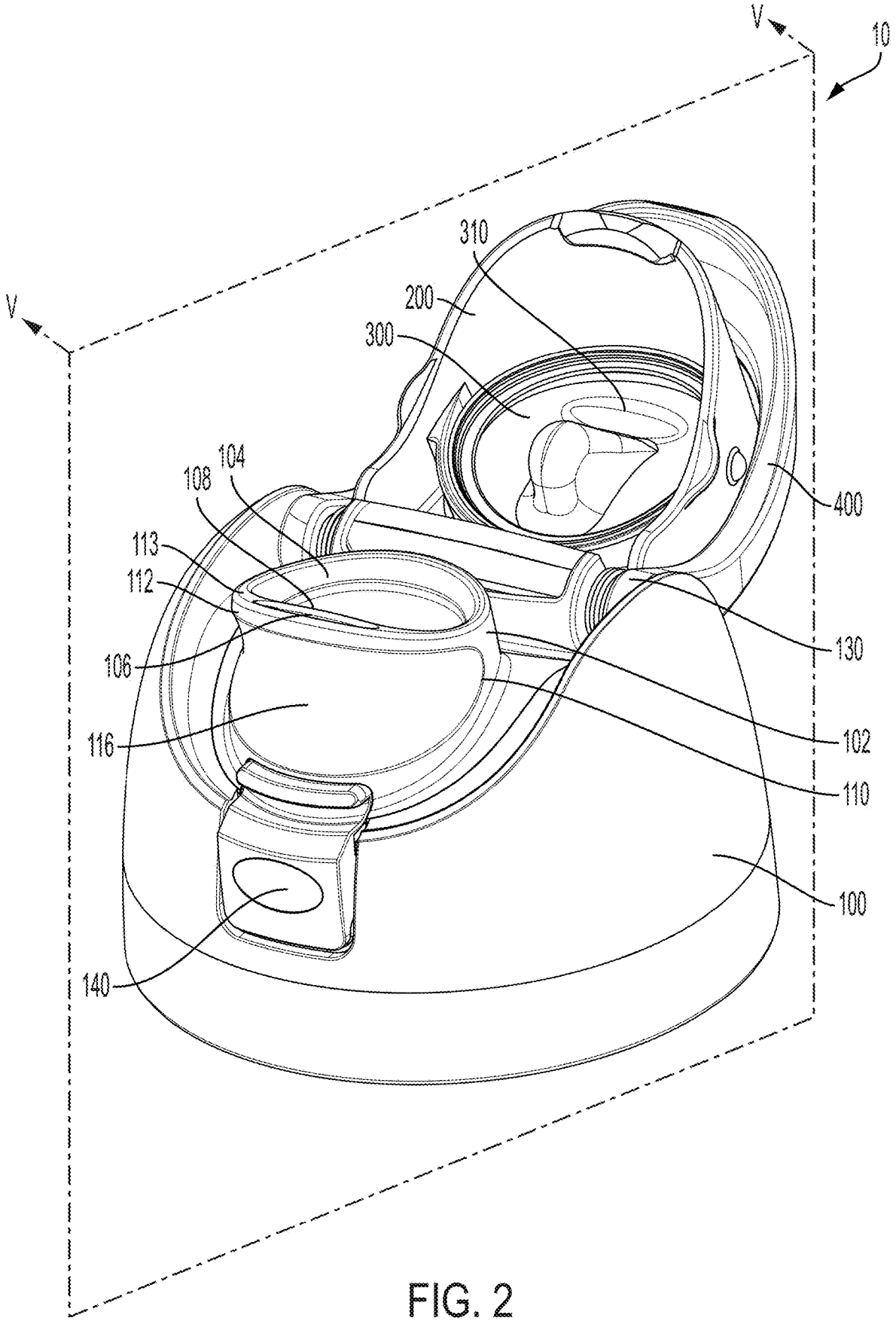
FIG. 2 shows a perspective view of the lid of FIG. 1 in an open position.
Figure 3:
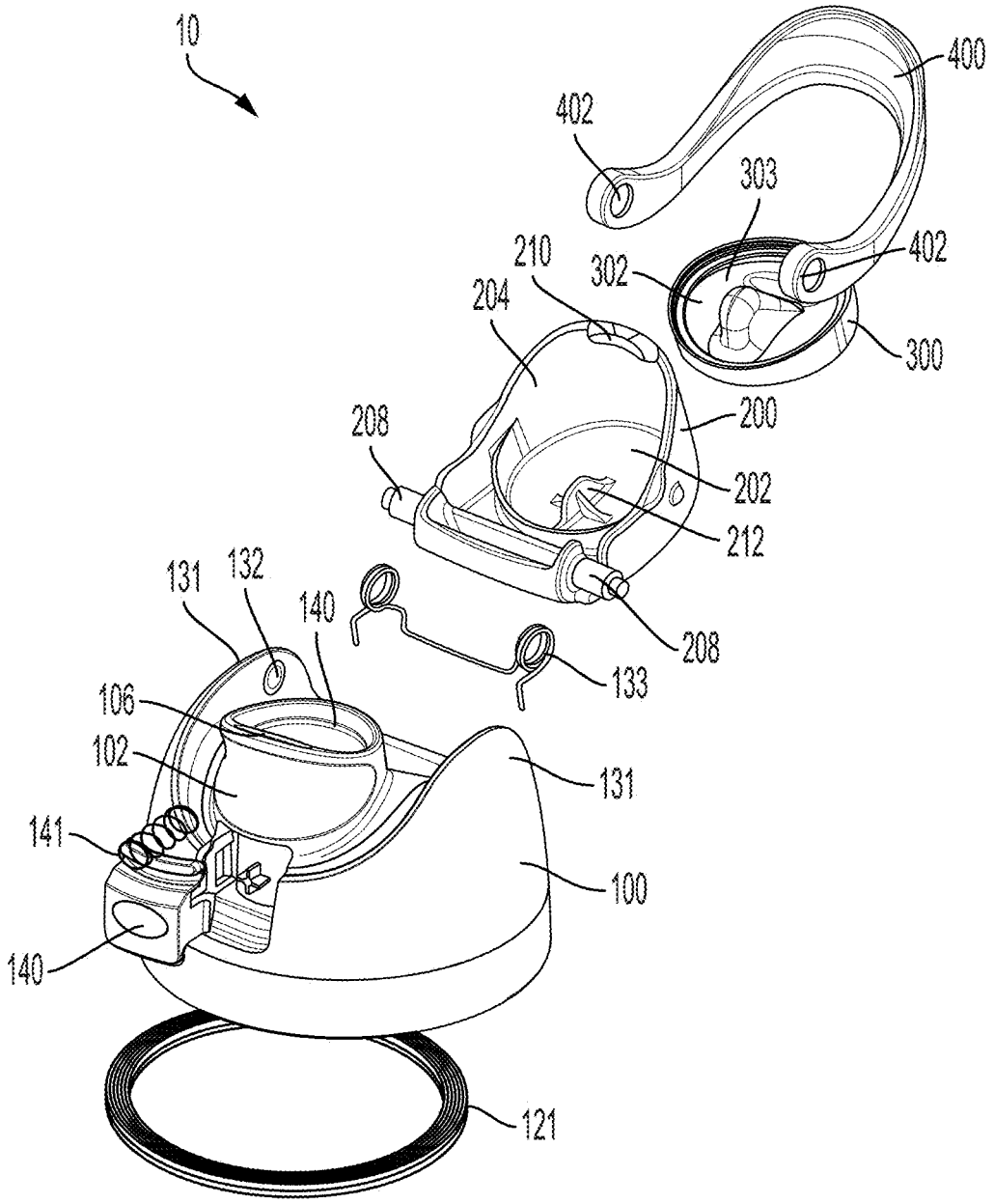
FIG. 3 shows an exploded perspective view of the lid of FIG. 1.
Figure 4:
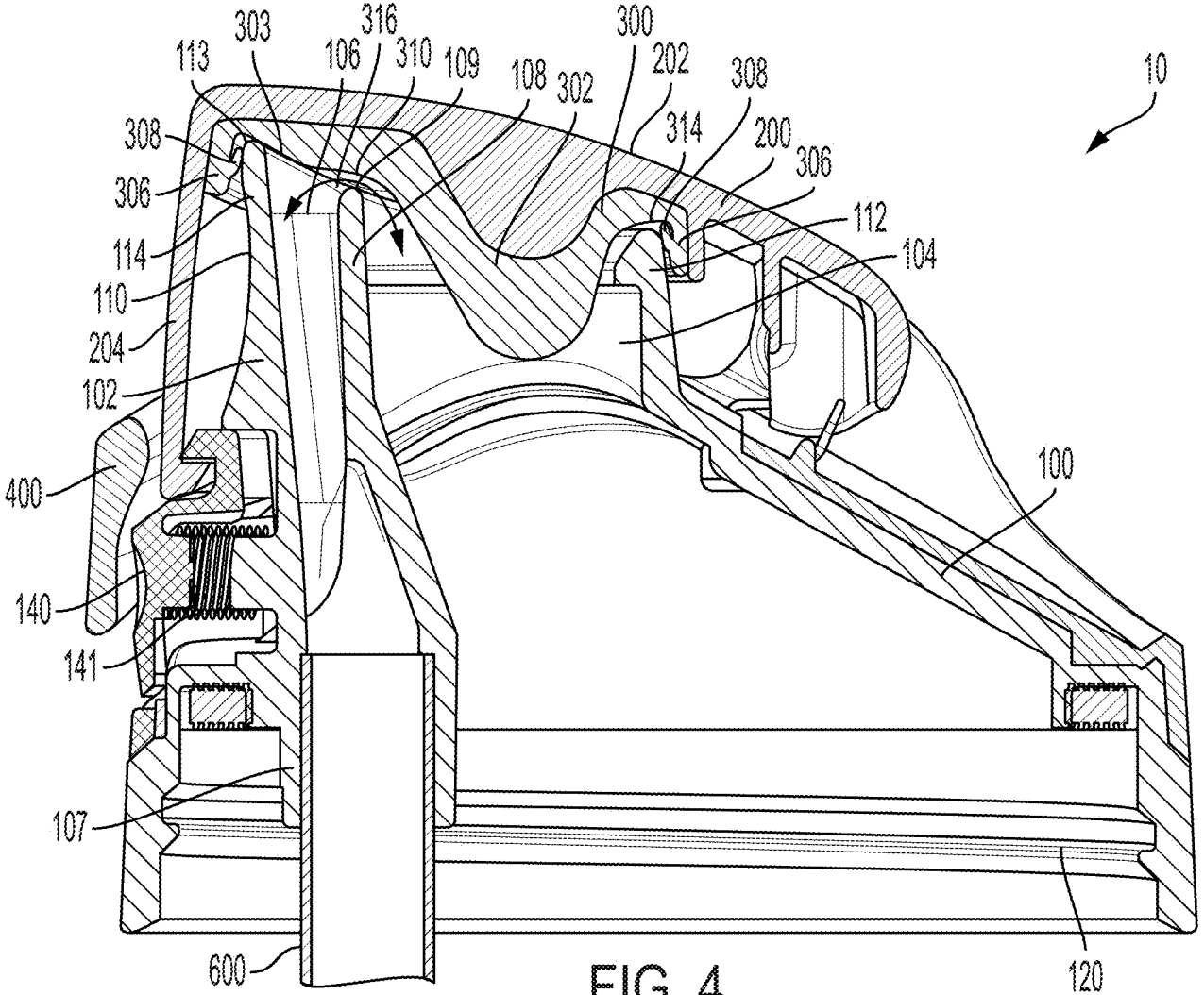
FIG. 4 shows a cross-sectional view the lid of FIG. 1 in a closed position, taken at line IV of FIG. 1.
Figure 5:
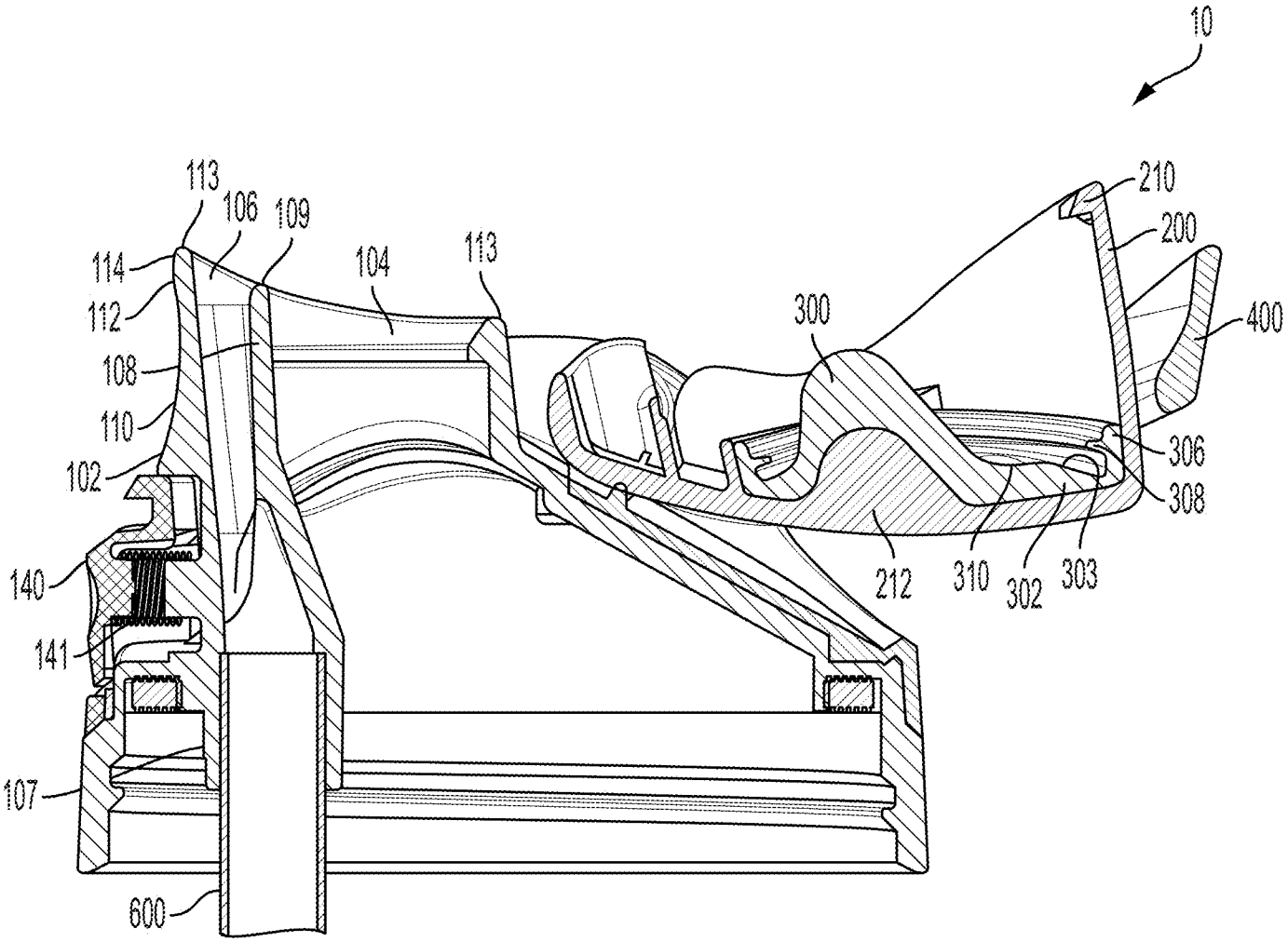
FIG. 5 shows a cross-sectional view the lid of FIG. 1 in an open position, taken at line V of FIG. 2.

FIG. 1 shows a lid 10 for beverage containers in a closed position according to some embodiments. FIG. 2 shows lid 10 in an opening position according to some embodiments. FIG. 3 shows an exploded view of lid 10 according to some embodiments. FIG. 4 is a cross sectional view of lid 10 taken along plane I shown in FIG. 1. FIG. 4 is a cross sectional view of lid 10 taken along plane II shown in FIG. 2.

As shown in FIGS. 1, in some embodiments, lid 10 includes a lid body 100 and a closure 200 coupled to lid body 100. In some embodiments, lid body 100 can be coupled to a beverage vessel 50 to form a beverage container through an attachment mechanism 120 on lid body 100 and a corresponding attachment mechanism 502 on vessel 50. In some embodiments, attachment mechanism 120 may be threaded connectors (as shown in FIGS. 3 and 4), friction fit connectors, snap-fit connectors, or any other suitable releasable attachment mechanism. In some embodiments, attachment mechanism 120 is attached over an upper exterior portion of vessel 50. In some embodiments, attachment mechanism 120 is attached inside an interior portion of vessel 50. The attachment of lid body 100 to vessel 50 is not limited to the arrangement shown in the figures. In some embodiments, lid body 100 includes a vessel seal member 121 to form a seal between lid 10 and vessel 50. The term seal as used here and elsewhere in this document does not necessarily require a perfect hermetic seal; rather a seal capable of inhibiting passage of liquid fluid is sufficient. Vessel 50 is shown in FIG. 1, but it is understood that vessel 50 is compatible of lid 10 shown in FIG. 1-5, and omitted in FIGS. 2-5 for clarity.

In some embodiments, a spout 102 is separated into a first drinking opening 104 and a second drinking opening 106 through which a user may drink a beverage contained within the beverage container. In some embodiments, second drinking opening 106 extends to a straw connector 107 to which a straw 600 can be attached, such that a user may drink the beverage through the straw by sucking on second drinking opening 106. In some embodiments, first drinking opening 104 is directly in fluid communication with vessel 50, such that a user may drink the beverage by tilting the beverage container and pouring the beverage through first drinking opening 104 and into the user's mouth.

In some embodiments, spout 102 is offset (toward a front of lid body 100) from a central vertical axis of lid body 100. In some embodiments, first drinking opening 104 is closer to a central vertical axis of spout 102 than second drinking opening 106. In some embodiments, second drinking opening 106 is offset from the central axis of spout 102. In some embodiments the central axis of spout 102 extends through first drinking opening 104. In some embodiments, second drinking opening 106 is offset from first drinking opening 104 towards a front of spout 102. In some embodiments, first drinking opening 104 is larger than second drinking opening 106. This may, for example, facilitate a user in drinking comfortably from first drinking opening 104 and/or second drinking opening 106.

In some embodiments, spout 102 is defined by an outer wall 110 extending from lid body 100. In some embodiments, outer wall 110 extends into a rim 112 having a top surface 113 and an outer surface 114. In some embodiments, outer wall 110 has a lip rest 116 that is slightly indented. Lip rest 116 may allow a user to more comfortably drink from a beverage container either by pouring a beverage from first drinking opening 104 or by sucking on second drinking opening 106.

In some embodiments, spout 102 has an annular shape. However, the shape of spout 102 is not limited to the shape shown in the figures. Rather, spout 102 may have any shape sufficient to allow dispensing of a beverage from a beverage container. In some embodiments, rim 112 of spout 102 has a planar shape, such that top surface 113 of rim 112 has a constant height. In some embodiments, rim 112 has a non-planar shape, such as a curved or an angled shape. In some embodiments, rim 112 is curved up, such that top surface 113 of rim 112 is higher towards the front of spout 102. In some embodiments, rim 112 is curved up, such that top surface 113 of rim 112 is higher towards second drinking opening 106.

In some embodiments, first drinking opening 104 and second drinking opening 106 together form spout 102. In some embodiments, spout 102 includes a separation wall 108 to separate first drinking opening 104 and second drinking opening 106, such that a first portion of outer wall 110 and separation wall 108 define first drinking opening 104, and a second portion of outer wall 110 and separation wall 108 define second drinking opening 106. In some embodiments, separation wall 108 has a top surface 109. In some embodiments, top surface 109 of separation wall 108 is lower than top surface 113 of rim 112. In some embodiments, when rim 112 is curved up, top surface 109 of separation wall 108 is lower than top surface 113 at the front of spout 102 but higher than top surface 113 at the rear of spout 102.

Spout 102 may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium).

In some embodiments, closure 200 is coupled to lid body 100 to cover and seal spout 102, which includes first drinking opening 104 and second drinking opening 106. In some embodiments, closure 200 is a flip-top cap that pivots from an open position (i.e. FIG. 2) to a closed position (i.e. FIG. 1) to seal spout 102, which includes first drinking opening 104 and second drinking opening 106. In some embodiments, closure 200 is pivotally coupled to lid body 100 through an attachment mechanism 130. In some embodiments, attachment mechanism 130 is a mount having a pair of posts 131. In some embodiments, each post 131 defines an opening 132. In some embodiments, closure 200 has a pair of protrusions 208 that can be inserted into openings 132 to provide a pivot coupling between closure 200 and lid body 100. In some embodiments, attachment mechanism 130 further includes a torsional spring 133 to bias closure 200 towards the open position (see, e.g., FIG. 2).

In some embodiments, closure 200 is retained in the closed position (shown, e.g., in FIG. 1) through an attachment mechanism 140 on lid body 100. In some embodiments, attachment mechanism 140 is a depressible latch 140 biased by a spring 141. In some embodiments, closure 200 has a protrusion 210 to engage with depressible latch 140 to retain closure 200 in the closed position. In some embodiments, the engagement of protrusion 210 and depressible latch 140 resists the biasing force from torsional spring 133. In some embodiments, depressible latch 140 can be depressed to disengage protrusion 210, so that closure 200 is released from the closed position and can move to the open position.

In some embodiments, closure 200 has a top portion 202 and a side wall 204, and when closure 200 is in the closed position, top portion 202 and side wall 204 may together at least partially enclose spout 102 to inhibit dirt or debris from contacting spout 102.

In some embodiments, a seal member 300 is coupled to closure 200 to seal spout 102, which includes first drinking opening 104 and second drinking opening 106. In some embodiments, seal member 300 has top portion 302. In some embodiments, top portion 302 has an inner surface 303 configured to face towards spout 102 when closure 200 is in a closed, sealing configuration and an outer surface 304 configured to face away from spout 102 when closure 200 is in the closed, sealing configuration. In some embodiments, seal member 300 includes a side wall 306 extending from top portion 302. In some embodiments, seal member 300 is larger than spout 102, such that side wall 306 can at least partially enclose rim 112 of spout 102 when closure 200 is in the closed position. In some embodiments, side wall 306 tapers inwardly as it extends away from top portion 302.

As shown in FIG. 4, in some embodiments, seal member 300 includes a sealing portion 308 extending from side wall 306 radially inward. In some embodiments, sealing portion 308 is a continuously inward projecting flange. In some embodiments, because sealing portion 308 extends radially inward, it seals spout 102 around outer surface 114 of rim 112 when closure 200 is in the closed position, and therefore seals both first drinking opening 104 and second drinking opening 106 simultaneously. The term seal as used here and elsewhere in this document does not necessarily require a perfect hermetic seal; rather a seal capable of inhibiting passage of liquid fluid is sufficient. In some embodiments, sealing portion 308 creates an airtight seal around outer surface 114 of rim 112 when closure 200 is in the closed position. In some embodiments, as closure 200 moves from the open position to the closed position, sealing portion 308 deflects when it contacts top surface 113 of rim 112 and then keeps moving to contact outer surface 114 of rim 112. In some embodiments, in the closed position, sealing portion 308 only contacts outer surface 114 of rim 112. In some embodiments, sealing portion 308 can be long enough such that, in the closed position, it contacts rim 112 from outer surface 114 up to a transitional between outer surface 114 and top surface 113.

In some embodiments, sealing portion 308 is the only portion of seal member 300 that contacts spout 102 when closure 200 is in the closed position. In some embodiments, top portion 302 of seal member 300 does not contact top surface 113 of rim 112 when closure 200 is in the closed position, such that a gap 314 is defined between inner surface 303 of seal member 300 and top surface 113 of rim 112.

In some embodiments, top portion 302 of seal member 300 does not contact top surface 113 of rim 112 at the front of spout 102. In some embodiments, top portion 302 of seal member 300 does not contact top surface 113 of rim 112 at the rear of spout 102. In some embodiments, top portion 302 of seal member 300 contacts top surface 113 of rim 112 but does not seal against top surface 113 of rim 112 when closure 200 is in the closed position. In some embodiments, the interface between seal member 300 and top surface 113 of rim 112 is not airtight.

In some embodiments that use a hinged flip-top closure 200 that secures with a latch (e.g., closure 200 and latch 140) it can be helpful to permit the closure to have some vertical space above the spout when latched, so that a user can more easily press closure down to engage the latch without interference from the spout, overtravelling the latch engagement position slightly. Once the latch is engaged, however, the natural bias of the closure toward the open position may lift it (and its seal, e.g., seal member 300) away from the spout, creating a gap (e.g., gap 314). In such a case, having seal 300 seal around outer surface 114 of rim 112 of spout 102 (rather than, e.g., on a top surface of spout 102) can maintain a strong seal even as closure 200 moves vertically slightly while latched, due to gap 314.

In some embodiments, side wall 306 of seal member 300 has an annular shape. However, the shape of side wall 306 is not limited to the shape shown in the figures. Rather, side wall 306 may have any shape sufficient to seal spout 102. In some embodiments, side wall 306 has a shape that conforms to the shape of rim 112 of spout 102. In some embodiments, seal member 300 has a planar shape, such that a front of seal member 300 (toward the front of spout 102 in the closed position) is at the same height with a rear of seal member 300 (toward the rear of spout 102 in the closed position). In some embodiments, seal member 300 has a non-planar shape, such as a curved or an angled shape. In some embodiments, inner surface 303 is curved up and higher towards the front of spout 102 when closure 200 is in the closed position.

Figure 7:
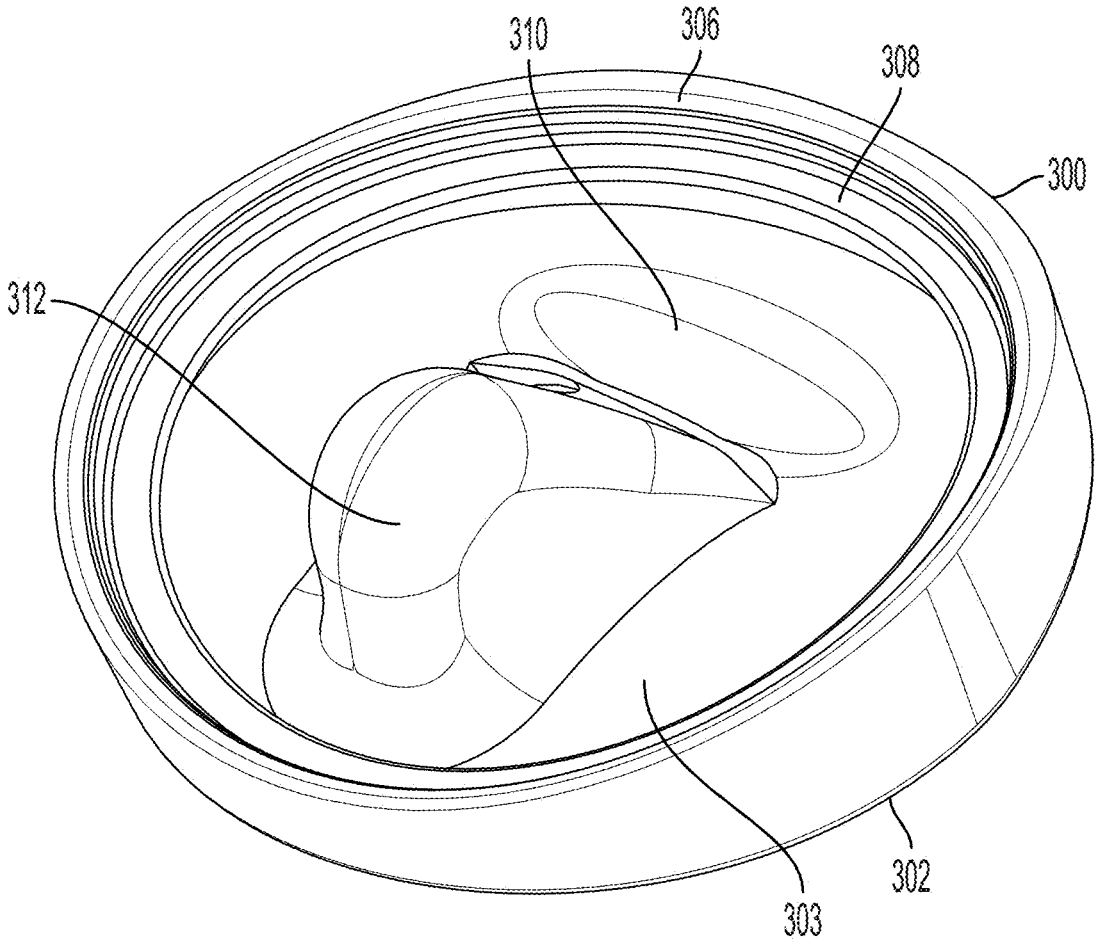
FIG. 7 shows a bottom perspective view of a seal for a closure of the lid of FIG. 1.

In some embodiments, top portion 302 of seal member 300 may contact separation wall 108 at top surface 109 but does not seal separation wall 108. In some embodiments, top portion 302 of seal member 300 does not contact separation wall 108. In some embodiments, inner surface 303 of seal member 300 has an indentation 310 curving away from spout 102 in the closed position, and when closure 200 is in the closed position, indentation 310 is disposed above separation wall 108 between first drinking opening 104 and second drinking opening 106 to create a channel 316 between indentation 310 and separation wall 108. In some embodiments, indentation 310 has an oval shape, as shown in FIG. 7. In the closed configuration, a major axis of the oval shape extends in the same direction as separation wall 108. In some embodiments, in the closed configuration indentation 310 does not extend beyond outer wall 110.

Because separation wall 108 is not sealed (e.g., due to indentation 310), first drinking opening 104 and second drinking opening 106 are not sealed independently, and channel 316 allow fluid communication between first drinking opening 104 and second drinking opening 106. The arrow in FIG. 4 demonstrates the air pathway between first drinking opening 104 and second drinking opening 106. This way, when closure 200 moves from the closed position to the open position, as soon as seal member 300 breaks, both first drinking opening 104 and second drinking opening 106 are unsealed simultaneously, air pressure in first drinking opening 104 and second drinking opening 106 can equalize together when spout 102 is unsealed, without causing much displacement of liquid below. 6.

Figure 6:
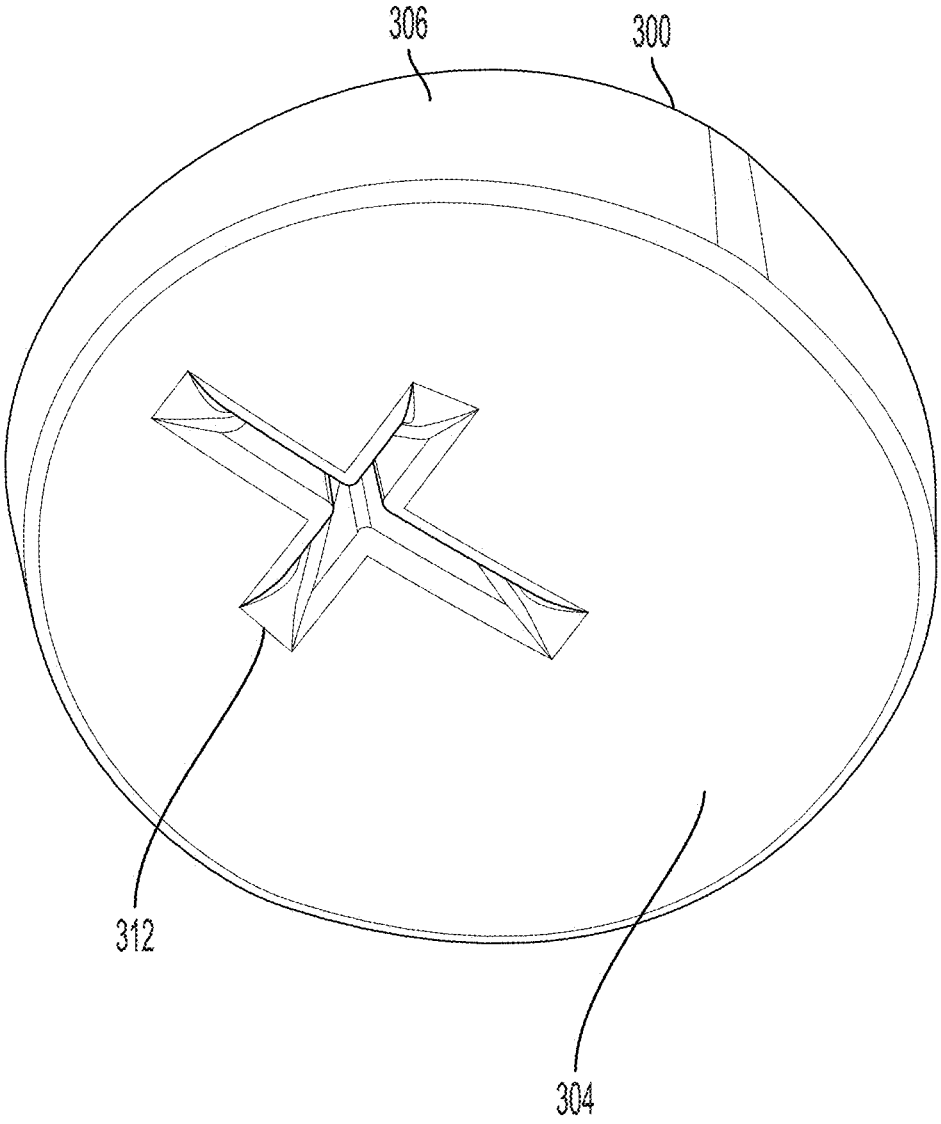
FIG. 6 shows a top perspective view of a seal for a closure of the lid of FIG. 1.

In some embodiments, seal member 300 is removably coupled to closure 200 through attachment mechanism 212. In some embodiments, attachment mechanism 212 is a mount 212 (e.g., a cross-shaped mount 212) protruding from top portion 202 of closure 200. In some embodiments, as shown in FIG. 6, seal member 300 has a corresponding slit 312 (e.g., cross-shaped slit 312) on outer surface 304 for receiving cross-shaped mount 212 of closure 200. In some embodiments, cross-shaped mount 212 is received within cross-shaped slit 312 to allow seal member 300 be secured in position (e.g., by a press fit or friction between mount 212 and slit 312). The cross shape as shown in the example embodiment may also help keep seal member 300 aligned so that it does not move or rotate relative to closure 200. Other shapes not having rotational symmetry could also be used. In some embodiments, seal member 300 protrudes into first drinking opening 104 to accommodate cross-shaped mount 212. This helps to keep a low profile of lid 10 while also keeping a strong yet removable connection between seal member 300 and closure 200. In some embodiments, seal member 300 can be removed from closure 200 for cleaning.

Seal member 300 may be formed of a food-grade material suitable to seal around outer surface 114 of spout 102. In some embodiments, seal member 300 may be formed of a resilient material (e.g., silicone). In some embodiments, seal member 300 may be formed of a material more resilient than the material of spout 102. In some embodiments, sealing portion 308 is formed of the same material as the rest of seal member 300. In some embodiments, sealing portion 308 is formed of a different material as the rest of seal member 300. In some embodiments, sealing portion 308 is formed of a material that is more resilient than the rest of seal member 300.

In some embodiments, lid 10 includes a handle 400. Handle 400 can pivot relative to lid body 100. In some embodiments, handle 400 is also pivotally coupled to lid body 100 through attachment mechanism 130 to reduce the number of attachment mechanisms in lid 10. Handle 400 can have opening 402, and protrusions 208 of closure 200 can extend through openings 402 into openings 132 of posts 131 to couple handle 400 between closure 200 and posts 131.

In some embodiments, handle 400 and closure 200 are independently pivotable relative to lid body 100, for example, handle 400 may not be biased by torsional spring 133. In some embodiments, handle 400 can move between a first position as shown in FIG. 1 and a second position as shown in FIG. 2. In the first position, handle 400 can at least partially cover depressible latch 140 so that depressible latch 140 cannot be depressed. This prevents accidental release of closure 200 from its closed position. In some embodiments, as shown in FIG. 1, closure 200 has retainers 214 to retain handle 400 in the first position, and a sufficient force is required to move handle 400 over retainers 214. This prevents handle 400 from accidentally moving away from the first position, thereby exposing depressible latch 140 to be depressed.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the claims and their equivalents.

What is claimed is:

1. A lid for beverage container, the lid comprising:

a lid body comprising:

a spout defining a first drinking opening and a second drinking opening through the lid body; and a latch;

a closure rotatably coupled to the lid body and configured to rotate between a closed position in which the closure covers the lid body and an open position in which the closure does not cover the lid body; and a seal member coupled to the closure and configured to seal around an outer surface of a rim of the spout when the closure is in the closed position, wherein there is a gap between an inner surface of the seal member and a top surface of the rim of the spout in the closed position, wherein the latch is configured to engage with the closure to retain the closure in the closed position.

2. The lid of claim 1, wherein the seal member does not contact a top surface of the rim of the spout in the closed position.

3. The lid of claim 1, wherein the seal member does not form a seal between the first drinking opening and the second drinking opening in the closed position.

4. The lid of claim 1, wherein the seal member comprises an indentation disposed above a wall separating the first drinking opening and the second drinking opening when the closure is in the closed position.

5. The lid of claim 4, wherein the indentation has an oval shape.

6. The lid of claim 1, wherein the rim of the spout has a non-planar shape and is higher towards the second drinking opening, and wherein the seal member does not contact a top surface of the rim in the closed position.

7. The lid of claim 6, wherein a wall separating the first drinking opening and the second drinking opening is lower than the rim of the spout, and wherein the seal member does not contact a top surface of the wall in the closed position.

8. The lid of claim 1, wherein the seal member comprises a side wall configured to seal around an outer surface of a rim of the spout and has a non-planar shape, and wherein the side wall has a tapered shape.

9. The lid of claim 8, wherein the side wall of the seal member comprises a continuously inward projecting flange configured to seal around the outer surface of the rim.

10. The lid of claim 1, wherein the seal member is removably coupled to the closure via a mount on the closure.

11. The lid of claim 10, wherein the mount is a cross shaped protrusion extending from the closure, and wherein the seal member comprises a cross shaped slot configured to engage with the protrusion.

12. The lid of claim 1, further comprising a spring, wherein the closure is biased towards the open position by the spring.

13. The lid of claim 1, wherein the latch is configured to be depressed to disengage the closure.

14. The lid of claim 1, wherein the second drinking opening extends to a straw connector configured to hold a straw.

15. The lid of claim 1, wherein the second drinking opening is offset from the first drinking opening towards a front of the spout.

16. A beverage container, comprising:

the lid of claim 1; and a vessel.

* * * * *